United States Patent [19]

Kruger et al.

[11] Patent Number: 4,698,794

[45] Date of Patent: Oct. 6, 1987

[54] DEVICE FOR REMOTE TRANSMISSION OF INFORMATION

[75] Inventors: Volker Kruger, Celle; Ulrich Hense, Hambühren, both of Fed. Rep. of Germany

[73] Assignee: Eastman Christensen, Salt Lake City, Utah

[21] Appl. No.: 757,711

[22] Filed: Jul. 22, 1985

[30] Foreign Application Priority Data

Aug. 6, 1984 [DE] Fed. Rep. of Germany ..... 3428931

[51] Int. Cl.[4] ..... H04H 9/00

[52] U.S. Cl. ..... 367/83; 367/81; 340/853; 340/861

[58] Field of Search ..... 367/81-85; 340/853, 861

[56] References Cited

U.S. PATENT DOCUMENTS

| | | | |
|---|---|---|---|
| 2,352,833 | 7/1944 | Hassler | 367/83 |
| 2,759,143 | 8/1956 | Arps | 367/83 |
| 2,958,821 | 11/1960 | Webb | 367/83 |
| 4,103,281 | 7/1978 | Storm et al. | 367/83 |

OTHER PUBLICATIONS

Ward et al., "Borehole Telemetry System is Key to Continuous Down-Hole Drilling Measurements", Sep. 1975, pp. 111-118.

*Primary Examiner*—Thomas H. Tarcza
*Assistant Examiner*—Daniel T. Pihulic
*Attorney, Agent, or Firm*—Walter Fred

[57] ABSTRACT

In a device for the transmission of information from a borehole to the surface during the operation of a drilling device which comprises a rotary drill bit, a tubular housing and a pump which delivers a drilling fluid downwards through the tubular housing, through the rotary drill bit and upwards in the annular space between the tubular housing and the borehole, there is provided a detector arranged in the tubular housing, for detecting information, a processor for converting that information into a sequence of electrical control signals and a transducer for generating pressure pulses in the downwardly-directed flow of drilling fluid as a function of the control signals, and a remote detector arranged at a position spaced from the processor by a wire-less transmission path with a transmitter unit associated with the remote detector at one end of said path and a receiver unit at the other end of said path.

7 Claims, 1 Drawing Figure

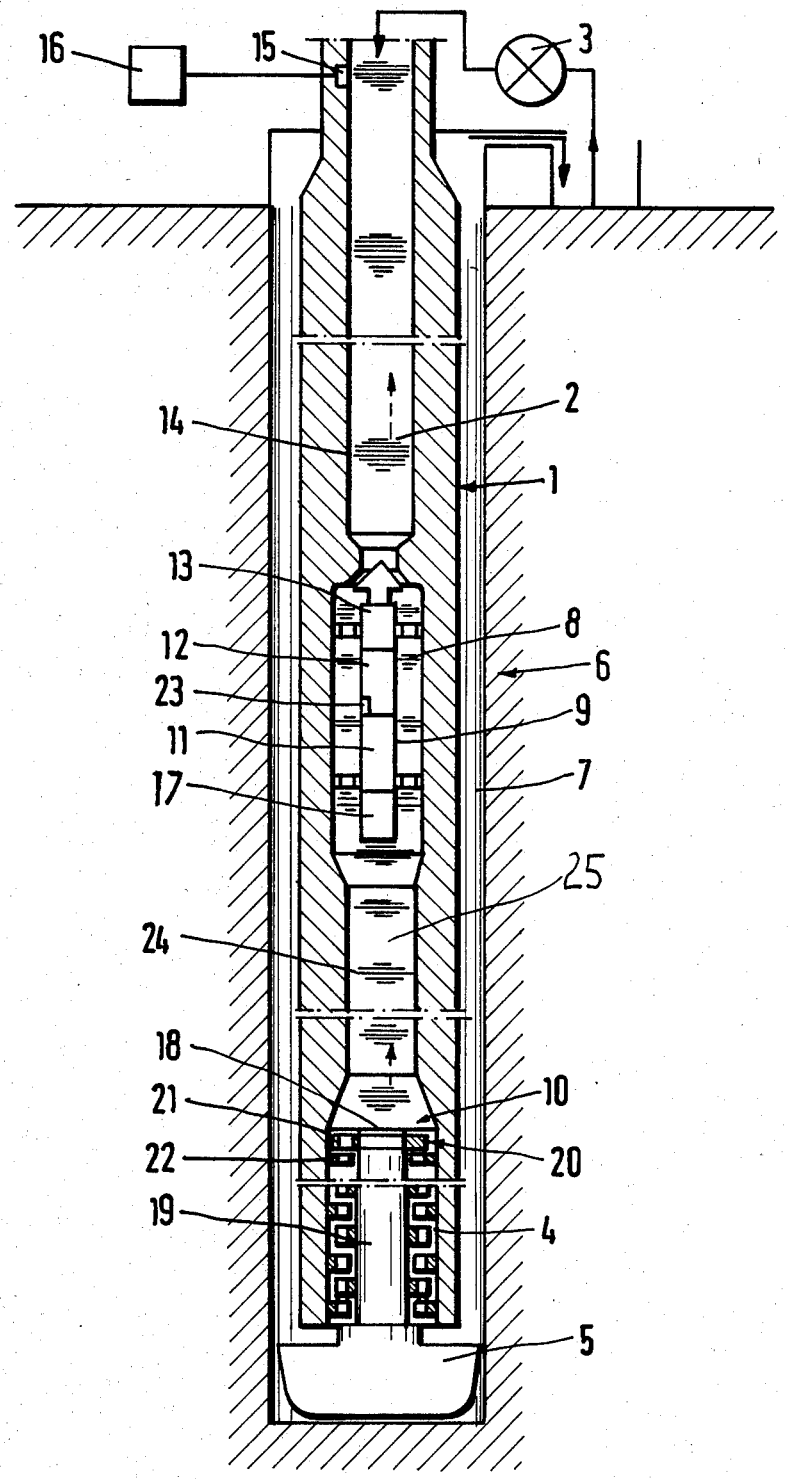
16
15
3
14
2
1
13
8
12
6
23
9
11
7
17
25
24
18
10
21
22
20
19
4
5

DEVICE FOR REMOTE TRANSMISSION OF INFORMATION

BACKGROUND OF THE INVENTION

Field of the Invention

This invention relates to a device for transmitting information from an underground borehole to the surface during drilling the borehole.

In known devices of this type, the instruments for detecting information and the processor for converting the information into a sequence of electric control signals are mounted in the same housing insert or in separate housing inserts which are disposed immediately adjacent to each other and which can be electrically coupled to each other, for example by plug connections. However, such an arrangement is suitable only for detector instruments which detect information which is derived from the proximity of the housing insert, for example, inclination, azimuth, temperature and pressure.

An object of the present invention is to provide a device capable of transmitting information derived from the proximity of the detector instruments and the processor and/or information derived from one or more remote detector instruments.

SUMMARY OF THE INVENTION

According to the present invention we provide a device for transmitting information from an underground borehole to the surface during drilling of the borehole comprising at least one detector means for detecting a variable and providing information as a function of said variable, a processor for converting said information from said detector means into electrical control signals and a transducer for generating in a drilling fluid pressure pulses as a function of said electrical control signals, the improvement comprising providing at least one detector means at a position remote from said processor, said remote detector means being separated from said processor by a wire-less transmission path having first and second ends and being provided with a signal transmitter at the first end of said transmission path and a signal receiver at the second end of said transmission path.

The invention makes it possible to transmit information from detector instruments to the processor even under conditions in which the provision of a cable or wire for a direct connection would be a problem due to production and/or installation requirements or to disturbances arising from the rough below-ground drilling conditions. In addition, the possibilities for combining detector instruments and processors are expanded.

Preferably the transmission path comprises the drilling fluid. It is preferred that the frequency spectrum emitted by the signal transmitter is different from that of the transducer which generates pressure pulses in said drilling fluid and, advantageously the frequency spectrum of the signal transmitter is higher than that of the transducer.

In one embodiment invention the remote detector means is a revolution detector associated with a drill bit drive. The signal transmitter may be in the form of a rotary slide valve.

BRIEF DESCRIPTION OF THE DRAWING

The single FIGURE of the drawings is a schematic longitudinal section of a device according to the invention in position in a borehole.

DESCRIPTION OF THE PREFERRED EMBODIMENT

The drilling device comprises a string of pipes forming a drill housing designated by reference numeral 1 the housing defining an internal flushing duct 2. During the operation of the drilling device, drilling fluid is pumped downwards through the internal flushing duct 2 by means of a pump 3 and passes on its way to the borehole bottom through a down-hole motor comprising a drilling turbine 4. The drilling fluid emerges through nozzles of a rotary drill bit 5 which is driven by the drilling turbine 4, into the borehole 6 and returns to the earth's surface through an annular space 7 surrounding the housing 1.

Above the turbine 4, a device, designated by reference numeral 8, is located. The device 8 comprises an information transmitting assembly 9 which includes, in a section 11, a number of instruments for detecting information such as, for example, inclination and azimuth, and a processor section 12 in which the information detected by the instruments arranged in section 11 is converted into a sequence of electric control signals. The control signals are used to control a transducer unit 13 for generating pressure pulses 14 in the drilling fluid flowing downwards through the internal flushing duct 2.

The pressure pulses generated in this manner and designated 14 are propagated towards the surface where they are detected by means of a pressure pick-up 15 and are supplied to a measurement-value output and processing unit 16. A generator or a battery pack housed in a section 17 is used for supplying the assembly 9 with power.

The assembly 9 also includes a receiver 23 in the form of a pressure pick-up. This is arranged to receive pressure pulses 24 emitted by the transmitter 20 which is remote from the assembly 9.

The processor is accommodated in section 12 of the assembly 9, and is capable of processing both the information derived from the instruments in section 11 and the information derived from at least one further instrument 10 which is remote from the assembly 9.

In the present case, the instrument 10 is used for detecting the speed of rotation of the turbine 4. This instrument 10 comprises a shaft 18 which is linked in suitable manner, such as by a coupling and, if necessary, a transmission, to the rotor 19 of the turbine 4. The shaft 18 is used for mechanically controlling a transmitter 20 which consists of a rotary slide valve 21, which is connected to the shaft 18 and a stationary diaphragm 22 which can be covered by the rotary slide valve 21 over a predetermined central angle.

The drilling fluid in the duct 2 below the assembly serves as a transmission path between the transmitter 20 and the receiver 23. This transmitter 20 serves to generate in the drilling fluid, continuous pressure pulses 24, which are propagated towards the assembly 9 where they are detected by the receiver unit 23 in the form of a pressure pick-up associated with the processor arranged in section 12.

The processor can further process the information obtained by way of the separate transmission path, in the same manner as it processes the information supplied to it from the instruments accommodated in section 11. The information obtained in this manner can then be transmitted in coded form to the surface by means of pressure pulses 14 generated by the transducer 13.

In order to prevent a disturbing influence on the unit 16 evaluating the pressure pulses 14, the pressure pulses 24 emitted by the transmitter unit 20 are preferably selected in a frequency spectrum which is different from the frequency spectrum of the pressure pulses 14. The transmission frequency of the pressure pulses 24 generated by the transmitter unit 20 is preferably selected to be higher than the frequency of the pressure pulses 14. This makes it possible to separate the pressure pulses 14 in a simple manner from the pressure pulses 24 by frequency selection means at the surface. In addition, the pressure pulses 24 are attenuated more than the pressure pulses 14 due to the low-pass characteristic of the transmission path for pressure pulses within the drilling fluid, so that, with adequate frequency separation, the decrease in amplitude of the pressure pulses 24 is also much greater than that of the pressure pulses 14.

The selection of different frequency spectra for the pressure pulses 24 and 14 also makes it possible to prevent any disturbing reaction effect by pressure pulses which are generated by the transducer 13 and act on the pressure pick-up and which have a reverse polarity in comparison with the pressure pulses 14.

We claim:

1. In a device for transmitting information from an underground borehole to the surface during drilling of the borehole comprising an information transmitting assembly mounted in a portion of a drill housing situated a remote distance from a drill bit and the surface including power supply means, at least one detector means for detecting a variable and providing information as a function of said variable, a processor connected to the detector means for converting said information from said detector means into electrical control signals and a transducer for generating in a drilling fluid forced through said drill housing a frequency spectrum of pressure pulses propagated toward and processed at the surface as a function of said electrical control signals, the improvement comprising:

at least one remote detector means situated at a position in the drill housing and borehole remote from said processor, said remote detector means being separated from said processor by a wire-less transmission path having first and second ends and being provided with a signal transmitter, associated with the remote detector means, at the first end of said transmission path for transmitting information from the remote detector at a different frequency spectrum than that of the transducer and a signal receiver at the second end of said transmission path connected to provide information detected by the remote detector to the processor for transmission to the surface by the transducer and in which the frequency spectrum emitted by the signal transmitter is different from that of the transducer which generates pressure pulses in said drilling fluid.

2. A device according to claim 1 in which the transmission path comprises the drilling fluid.

3. A device according to claim 2 in which the frequency spectrum of the signal transmitter is higher than that of the transducer.

4. A device according to claim 1 in which the remote detector means is a revolution detector associated with a drill bit drive.

5. A device according to claim 4 in which the signal transmitter is in the form of a rotary slide valve.

6. Drilling apparatus for drilling underground boreholes comprising:

a down-hole motor adapted to be driven by a drilling fluid forced downwardly through a tubular housing to said motor;

drive means arranged to be driven by the down-hole motor;

a drill bit arranged to be driven by the drive means;

means for forcing drilling fluid downwardly through said tubular housing from and backup to an upper surface about the borehole;

an information transmitting assembly mounted within a section of said housing situated a remote distance from the upper surface and the drill bit and said information transmitting assembly including power supply means, at least one detector means for detecting a variable and providing information as a function of said variable, a processor connected to the detector means for converting said information from said detector means into electrical control signals and a transducer for generating in said downwardly flowing drilling fluid a frequency spectrum of pressure pulses propagated toward and processed at the upper surface as a function of said electrical control signals;

a receiver for receiving said pressure pulses generated by said transducer and propagated toward and processed at the upper surface;

a remote detector means situated at a position in the housing and borehole remote and separated from said processor, for detecting a variable;

pressure pulse transmitting means associated with said remote detector means to generate and transmit pressure pulses in said drilling fluid and which pulses are a function of information detected by said remote detector means and transmitted at a different frequency spectrum than that of the transducer; and a signal receiver for receiving said pressure pulses from said transmitting means associated with said remote detector, said signal receiver being positioned in said information transmitting assembly and connected to provide information detected by the remote detector to said processor for transmission to the upper surface by the transducer.

7. Drilling apparatus according to claim 6 in which the remote detector means is arranged to determine the speed of rotation of the down-hole motor.

* * * * *